US011866210B2

(12) United States Patent
Grondinger et al.

(10) Patent No.: US 11,866,210 B2
(45) Date of Patent: Jan. 9, 2024

(54) SEALING STATION FOR SEALING PACKAGING UNITS

(71) Applicant: MULTIVAC SEPP HAGGENMUELLER SE & CO. KG, Wolfertschwenden (DE)

(72) Inventors: Bastian Grondinger, Biessenhofen (DE); Christoph Zettler, Tannheim (DE); Markus Weiland, Bad Groenenbach (DE)

(73) Assignee: Multivac Sepp Haggenmueller SE & Co. KG, Wolfertschwenden (DE)

( * ) Notice: Subject to any disclaimer, the term of this patent is extended or adjusted under 35 U.S.C. 154(b) by 0 days.

(21) Appl. No.: 18/086,527

(22) Filed: Dec. 21, 2022

(65) Prior Publication Data

US 2023/0192336 A1 Jun. 22, 2023

(30) Foreign Application Priority Data

Dec. 22, 2021 (DE) ..... 102021134192.2

(51) Int. Cl.
*B65B 31/04* (2006.01)

(52) U.S. Cl.
CPC ..... *B65B 31/046* (2013.01)

(58) Field of Classification Search
CPC ..... B65B 31/046; B65B 31/06; B65B 31/021; B65B 31/028
See application file for complete search history.

(56) References Cited

U.S. PATENT DOCUMENTS 3,061,984 A 11/1962 Mahaffy
3,343,332 A * 9/1967 Mahaffy ..... B65B 47/00 53/511
4,201,030 A * 5/1980 Mahaffy ..... B65B 31/021 426/396
4,831,811 A * 5/1989 Nixon, Jr. ..... B65B 31/021 53/511
4,896,479 A * 1/1990 Gannon ..... B65B 31/06 53/471

(Continued)

FOREIGN PATENT DOCUMENTS

DE 12 89 772 B 2/1969
DE 1 461 996 A1 3/1969

(Continued)

OTHER PUBLICATIONS

German Search Report dated Aug. 19, 2022, Application No. 10 2021 134 192.2, Applicant MULTIVAC Sepp laggenmueller SE & Co. KG, 5 Pages.

(Continued)

*Primary Examiner* — Andrew M Tecco
*Assistant Examiner* — Nicholas E Igbokwe
(74) *Attorney, Agent, or Firm* — Brooks Kushman P.C.

(57) ABSTRACT

A sealing station for sealing packaging units comprises a lower tool with at least one receptacle for a packaging unit and an upper tool. The lower tool and the upper tool are arranged to be movable relative to one another. The sealing station further comprises an edge extractor with at least one extraction opening for subjecting an interior of the packaging unit to a vacuum and/or a gas, and the lower tool comprises a lifting element for lifting a film cover of the packaging unit.

20 Claims, 3 Drawing Sheets

(56) References Cited

U.S. PATENT DOCUMENTS

| | | | | |
|---|---|---|---|---|
| 2008/0104930 | A1* | 5/2008 | Sparakowski | B65B 31/06 53/510 |
| 2012/0267036 | A1* | 10/2012 | Bartoli | B29C 66/81431 156/87 |
| 2019/0031379 | A1* | 1/2019 | Palumbo | B65B 31/06 |

FOREIGN PATENT DOCUMENTS

| | | | |
|---|---|---|---|
| DE | 1 511 708 | A1 | 9/1969 |
| DE | 38 73 990 | T2 | 3/1993 |
| DE | 10 2018 132 897 | A1 | 6/2020 |
| EP | 1 908 689 | A2 | 4/2008 |
| WO | 2011/124548 | A1 | 10/2011 |
| WO | 2014/056806 | A1 | 4/2014 |

OTHER PUBLICATIONS

European Search Report (with English Machine Translation) dated Jul. 3, 2023, Application No. 22202078.6-1014, Applicant MULTIVAC Sepp Haggenmüeller SE & Co. KG, 12 pages.

* cited by examiner

SEALING STATION FOR SEALING PACKAGING UNITS

CROSS-REFERENCE TO RELATED APPLICATIONS

This application claims foreign priority benefits under 35 U.S.C. § 119(a)-(d) to German patent application number DE 10 2021 134 192.2, filed Dec. 22, 2021, which is incorporated by reference in its entirety.

TECHNICAL FIELD

The present disclosure relates to a sealing station for sealing packaging units and a method for sealing a packaging unit with a sealing station.

BACKGROUND

Sealing stations are known in principle from prior art. They are typically used to seal plastic packaging units with a product disposed inside, such as sausage or cheese.

For this purpose, the sealing stations comprises a lower tool in which one or more receptacles are formed in which a lower part (or packaging tray) of a packaging unit can be received. A plastic film is then typically placed onto the lower part of the packaging unit as a packaging cover or film cover and the packaging unit is sealed by moving an upper tool of the sealing station and the lower tool in the direction towards one another and by introducing heat in the region of the film cover, in that the lower part of the packaging unit and the film cover are fused together.

Before sealing occurs, air can be extracted from the space inside the packaging unit or the air inside the packaging unit can be replaced with the most sterile gas possible, such as nitrogen.

Corresponding devices are known in particular from WO 2011/124548 A1 and EP 1 908 689 A2. According thereto, the lower tool of the sealing station typically comprises an edge extractor which can comprise extraction openings in a region between two sealing elements which allow air to be extracted in the region of the packaging unit.

However, by applying a vacuum or generally a gas flow, the film cover is drawn in the direction of the extraction openings. If it rests on the extraction openings, this can result in the partial blocking of the extraction openings. This reduces the extraction power. This can ultimately result in the air being extracted from the interior of the packaging unit less effectively and/or result in a reduction in the throughput of the sealing station.

SUMMARY

Proceeding from known prior art, a technical objective to be satisfied is therefore to increase the reliability when extracting the interior of a packaging unit before the packaging unit is sealed and at the same time to achieve the highest throughput possible.

A sealing station according to the disclosure for sealing packaging units comprises a lower tool with at least one receptacle for a packaging unit and an upper tool, where the lower tool and the upper tool are arranged to be movable relative to one another, where the sealing station comprises an edge extractor with at least one extraction opening for subjecting the interior of the packaging unit to a vacuum and/or a gas and where the lower tool further comprises a lifting element for lifting a film cover of the packaging unit.

The lifting element is preferably configured such that it can cause the film cover of the packaging unit to be lifted away from the lower part of the packaging unit (also referred to as a packaging tray) and thereby in a direction away from the lower tool. It can be provided that the lifting comprises selective lifting of the film cover. Selective lifting is to be understood in particular such that the film cover does not have to be lifted permanently, but can be lifted at least while the interior of the packaging unit is being subjected to the vacuum and/or a gas, but can be lowered at least while the upper tool is being lowered and the sealing process is carried out for sealing the packaging unit so that the film cover rests on the packaging tray and sealing of the entire packaging unit can be caused.

By lifting the film cover of the packaging unit at least while the interior of the packaging unit is being subjected to a vacuum and/or a gas, it is ensured that the at least one extraction opening is kept open. This reliably ensures that the air is extracted from the packaging unit. At the same time, it can be achieved in this way that the extraction capacity can be increased over prior art devices without the extraction openings being closed at least in part.

It can be provided that the lower tool comprises a sealing element at a distance from the center of the receptacle and the upper tool comprises a counter-pressure element which can be made to contact the sealing element for sealing the interior of the packaging unit from the exterior, and where the extraction opening is arranged at a distance from the center of the receptacle which is shorter than the distance of the sealing element from the center, and where the lifting element is arranged at a distance from the center of the receptacle which is shorter than the distance from the sealing element to the center.

The sealing element can preferably interact with the upper tool by way of the counter-pressure element such the no surrounding air can enter into the region between the upper tool and the lower tool, in particular during the sealing process, so that there is no renewed contamination after the evacuation and/or the ingress of gas has been completed until the packaging unit has been closed. The arrangement of the extraction opening and the lifting element within the region thus enclosed by the sealing element and the upper tool ensures reliable sterilization of the interior of the packaging unit.

In one embodiment, the lifting element does not coincide with the extraction opening. In the context of this embodiment, the lifting element is provided to be physically separate from the extraction opening itself and also from a structure forming the extraction opening, for example, is arranged next to the extraction opening and at a distance therefrom. With this embodiment, the extraction opening can be reliably kept open in a structurally simple manner.

Furthermore, the edge extractor can comprise a plurality of extraction openings which are arranged at a distance from the center of the receptacle which is shorter than the distance of the sealing element from the center of the receptacle, and where the lifting element is arranged between two adjacent extraction openings.

With this embodiment, it is possible by using a single lifting element to ensure that at least two extraction openings are kept open, which can reduce the required number of lifting elements and at the same time causes the extraction opening to be reliably kept open.

In a further development of this embodiment, a lifting element is arranged between each two adjacent extraction openings. In this embodiment, the lifting element and the extraction opening each alternate, so that a lifting element and an extraction opening (as seen, for example, along the direction of transport of the packaging units) are provided in alternation. As a result, each of the extraction openings can be kept open so that the extraction performance and therefore also the throughput can be high, for example, even if several receptacles and a plurality of extraction openings are provided.

It is provided in one embodiment that the lower tool comprises an inner sealing element which is arranged at a distance from the center of the receptacle that is shorter than the distance of the extraction opening and the distance of the lifting element from the center of the receptacle.

The inner sealing element can serve as a support surface for the actual sealing mechanism of the sealing station for sealing the packaging unit. The arrangement of the lifting element and the extraction opening between this inner sealing element and the outer sealing element ensures, firstly, the reliable extraction or evacuation or application of gas to the interior of the packaging unit and, secondly, that any negative impact on the sealing process by the lifting element and/or the extraction opening is prevented. Together, this can improve the sealing result.

In a further embodiment, the lifting element is formed in the shape of a pin which comprises a closed contact surface which can contact a film cover resting thereon. This embodiment is particularly preferred for packaging units with a comparatively dimensionally stable film cover, since material for the lifting elements can be saved and reliable lifting is nevertheless ensured.

Alternatively, it can be provided that the lifting element has an elongate contact surface that can contact a film cover, and where the contact surface has a first extension in a first direction that is greater than a second extension of the contact surface in a second direction.

The elongate contact surface can be, for example, a rectangular contact surface or a contact surface in the shape of a segment of a circular arc. By increasing the contact surface, accidental damage to the film cover can be prevented. In terms of this embodiment, the contact surface does not necessarily have to be flat, but can also represent a curved two-dimensional surface whose outer contour has a first extension in a first direction which is greater than a second extension in a second direction. This alignment is measured in Euclidean metrics and, in particular in the case of a curved contact surface, not along the contact surface and the metric thus defined, but rather as the actual distance from oppositely disposed edges of the contact surface.

A method according to the disclosure for sealing a packaging unit is carried out with a sealing station for sealing packaging units, the sealing station comprising a lower tool with at least one receptacle for a packaging unit and an upper tool, where the lower tool and the upper tool are arranged to be movable relative to one another, where the sealing station comprises an edge extractor with at least one extraction opening for subjecting the interior of the packaging unit to a vacuum and/or a gas and where the lower tool comprises a lifting element for lifting a film cover of the packaging unit, where the method comprises lifting the film cover of the packaging unit in the receptacle by the lifting element at least in part while the interior of the packaging unit is subjected to a vacuum and/or a gas by the edge extractor.

This method ensures that the interior of the packaging unit is reliably evacuated or the air within the packaging unit is replaced with the most sterile gas possible.

The lifting element causing the film cover of the packaging unit to be lifted in the receptacle at least in part while the interior of the packaging unit is subjected to a vacuum and/or a gas is to be understood such that this lifting does not have to be permanent, depending on the design of the lifting element, but can also take place selectively, so that the lifting element, to the extent that it is configured as an actuatable lifting element, causes the film cover to be lifted at least during a period of time over which the interior of the packaging unit is subjected to a vacuum and/or a gas. This does not have to be the entire period of time, but can also only take place over part of this period of time.

It can be provided in particular that the method comprises lifting the film cover through an opening in a base film of the packaging unit using the lifting element. The opening in the base film in this embodiment can be formed, for example, by removing part of the material of the base film. With suitable positioning, the lifting element can then pass through the resulting open space in the base film for lifting the film cover. Alternatively, it can also be provided that the opening is formed by a partial perforation of the base film, where material of the base film remains in the region of the opening and is connected to the remainder of the base film. The material remaining in the region of the opening is preferably connected to the base film on only one side, so that it can be flexed by the lifting element on the one side opposite the base film. The lifting element can then pass through the base film in the region of the opening for lifting the film cover.

Reliable extraction can be ensured with this embodiment, even with congruent film covers and base films which together form the packaging unit.

After the interior of the packaging unit has been subjected to a vacuum and/or a gas, it can be provided that the upper tool and the lower tool are moved towards one another and the packaging unit arranged in the receptacle is sealed.

It can further be provided in an embodiment that the lower tool comprises a sealing element at a distance from the center of the receptacle and the upper tool comprises a counter-pressure element which is made to contact the sealing element before the edge extractor is actuated for sealing the interior of the packaging unit from the exterior, and where the extraction opening is arranged at a distance from the center of the receptacle that is shorter than the distance of the sealing element from the center, and where the lifting element is arranged at a distance from the center of the receptacle that is shorter than the distance of the sealing element from the center and where the lifting element optionally does not coincide with the extraction opening. This relative arrangement ensures that no outside air can enter into the interior of the packaging unit during extraction.

In a further development of this embodiment, the edge extractor comprises plurality of extraction openings which are arranged at a distance from the center of the receptacle which is shorter than the distance of the sealing element from the center of the receptacle, and where the lifting element is arranged between two adjacent extraction openings and where a lifting element is optionally arranged between each two adjacent extraction openings.

This arrangement of the one or more lifting elements makes it possible to ensure that every extraction opening is kept open to the extent possible, in particular with a plurality of extraction openings. The reliability and/or the throughput when sealing the containers can thus be increased.

Furthermore, the lower tool can comprise an inner sealing element which is arranged at a distance from the center point of the receptacle which is shorter than the distance of the extraction opening and the distance of the lifting element from the center of the receptacle. This configuration results in the packaging units being reliably sealed without any possible disruptive influence of the extraction opening and/or of the lifting element.

It can also be provided that the lifting element is formed in the shape of a pin which comprises a closed contact surface which can contact a film cover resting thereupon. This embodiment uses the least material possible, which reduces the costs for sealing packaging units.

It can be provided as an alternative thereto that the lifting element has an elongate contact surface contacting a film cover, and where the contact surface has a first extension in a first direction that is greater than a second extension of the contact surface in a second direction. This embodiment also ensures that the extraction openings are reliably kept open when the film cover material is flexible.

DETAILED DESCRIPTION

Figure 1A:
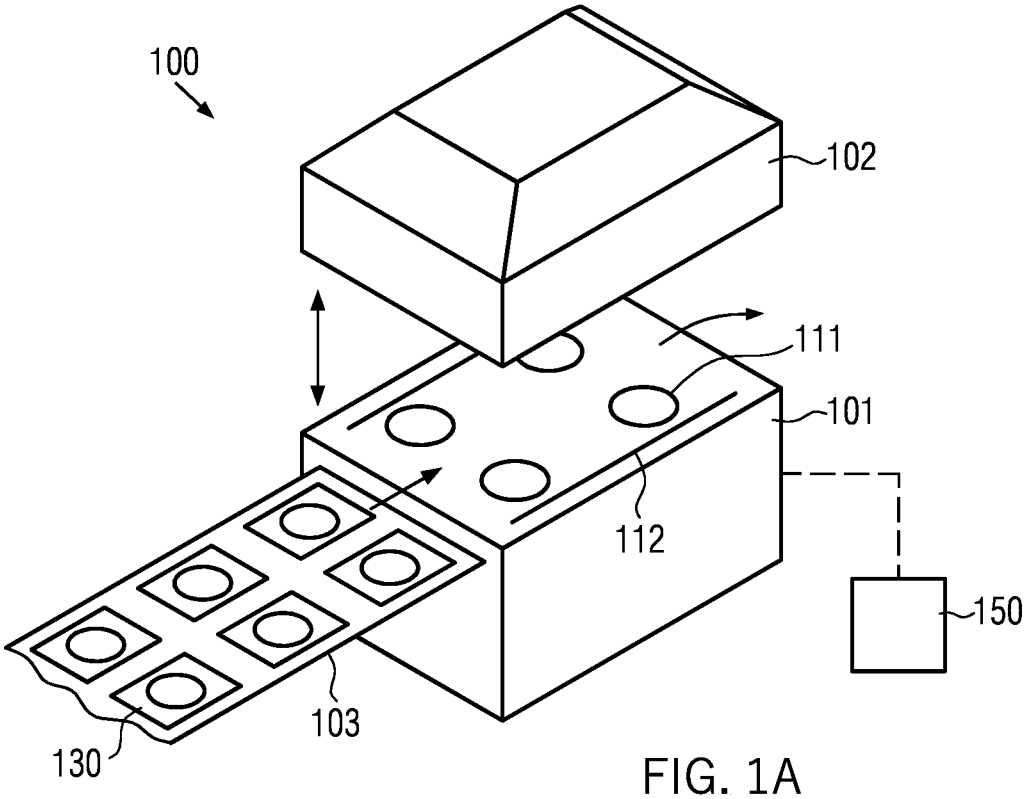
FIG. 1A (PRIOR ART)
FIGS. 1A and 1B show a sealing station according to an embodiment.

FIG. 1A shows a sealing station 100 according to an embodiment of the present disclosure. As is known from prior art, sealing station 100 typically comprises a lower tool 101 and an upper tool 102. Lower tool 101 and upper tool 102 are typically movable relative to one another, so that, for example, upper tool 102 can be moved in the direction of lower tool 101 and away from it, as shown schematically by the double arrow.

Respective sealing stations 100 are typically used to seal plastic packaging units in which, for example, foods such as sausage products or cheese products are packaged.

For this purpose, undersides of packaging units 130 that are still unsealed, also referred to as packaging trays or base film 131 (see FIG. 1B), with the product filled therein, are fed to at least one receptacle 111 in lower tool 101, for example, by transport device 103, which is presently shown only schematically. Transport device 103 can be configured, for example, as a transport belt. Other embodiments are presently also conceivable and the disclosure is not restricted in this regard.

As is known, the packaging trays with the product arranged therein are made to contact a cover film 112 so that the cover film is placed onto these packaging units. The cover film serves as a film cover at least in part and is fused to the packaging tray by the action of heat. Sealing station 100 can be associated with a control unit 150, for example, a computer, which controls the functions of the sealing station.

Figure 1B:
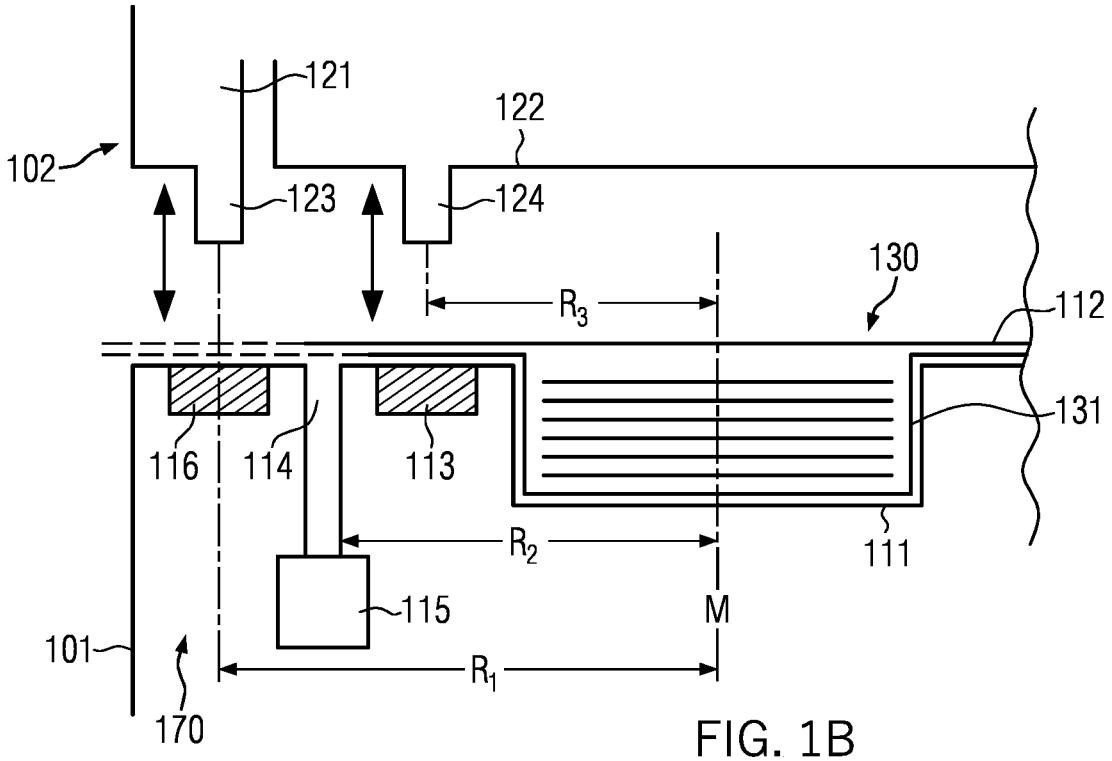

FIG. 1B shows a sectional view of a receptacle 111 of lower tool 101 with a packaging unit 130 arranged therein and an upper tool 102 positioned relative thereto. The section there is in a plane perpendicular to the direction of transport of the packaging units in transport device 103 and through the center M of the receptacle. In the embodiment presently shown, the receptacle has a regular shape, for example, the shape of a cylindrical depression in the lower tool. This configuration is not mandatory and other shapes, possibly even irregular ones, are also conceivable. Nevertheless, each of these shapes can be associated with a center point.

As shown, packaging unit 130 is formed from a packaging tray 131 or base film 131, respectively, and an upper film 112 or film cover 112, respectively, positioned relative thereto.

As can be seen, the lower tool can comprise an outer sealing element 116 and an inner sealing element 113 at certain distances R1 and R3.

Outer sealing element 116 can be made to contact a counter-pressure element 123 of an outer part 121 of upper tool 102, so that the space enclosed between outer part 121 of the upper tool and the lower tool is separated from the environment to the degree possible, so that no gas exchange can take place between the enclosed space and the environment. The packaging unit is then located in the enclosed space and is thus separated from the environment. It can be provided that film cover 112 and base film 131 extend beyond outer sealing element 116 into the exterior region, when viewed from center M of receptacle 111, (as indicated by the dashed widening of the film cover and the base film). In this case, outer sealing element 116 and counter-pressure element 123 then compress film cover 112 and base film 131 as completely as possible and seal the interior as in as gas-tight a manner possible, so that no unwanted contamination occurs due to the ingress of contaminated outside air.

Inner sealing element 113 can preferably be made to contact a sealing element 124 of a sealing part 122 of upper tool 102, where part of base film 131 and part of film cover 112 can be received between these two elements, so that the part of base film 131 and the part of film cover 112 fuse when heat is applied by sealing element 124.

Before or while the packaging unit is sealed by joining film cover 112 and base film 131, as just described, it is known to either evacuate the interior of packaging unit 130 and/or to displace the air disposed therein using the most sterile gas possible, for example, nitrogen. For this purpose, an edge extractor 170 with an extraction opening 114 can be arranged in the lower tool at a distance R2 from the center of receptacle 111, and exchanges or extracts the gas volume located in the enclosed space, for example, via a vacuum pump 115 or by way of a gas supply 115 of edge extractor device 170, in order to remove in particular the gas volume within the packaging unit or replace it with the most sterile gas possible. Extraction opening 114 is preferably disposed between sealing elements 113 and 116.

This procedure is basically known from prior art. However, it entails the drawback that extraction opening 114 can be closed or covered by parts of the film cover material 112 while gas is extracted or even supplied, which can adversely affect the extraction performance.

Figure 2A:
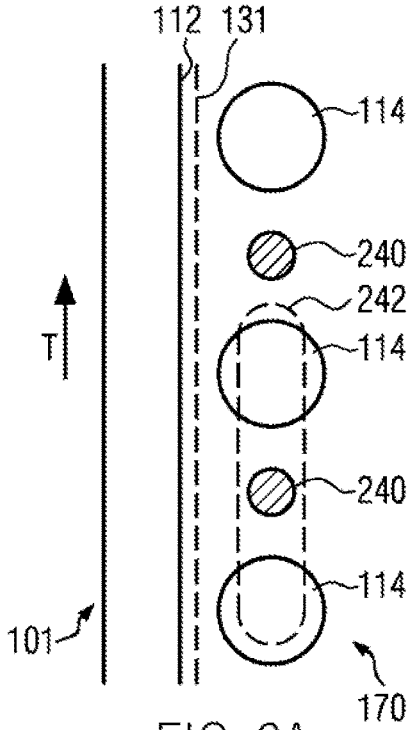
FIGS. 2A to 2C show a top view and a side view of part of a sealing station according to an embodiment as well as the film cover of a packaging being lifted.
Figure 2B:
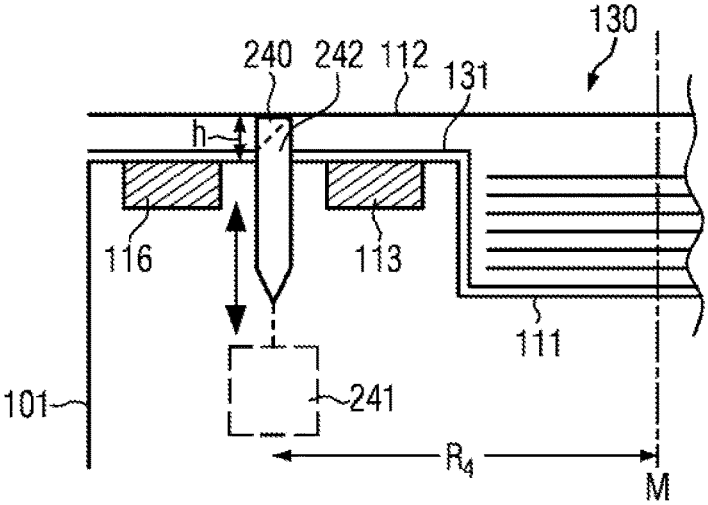

According to the disclosure, lower tool 101 therefore comprises at least one lifting element which is described in the context of FIGS. 2A and 2B.

FIG. 2A shows a top view onto the region of lower tool 101 in which an edge extractor 170 with one or more extraction openings 114 is arranged. Film cover 112 and the edge of base film 131 are presently also shown. In the view presently shown, base film 131 and film cover 112 extend approximately the same distance from center M of receptacle 111. In this case (as also shown there by a broken line), an opening 242 can be provided in base film 131 in the region of extraction openings 114. This opening can be formed either by removing material (see FIG. 2C) of the base film at least in part from the remainder of base film 131 or by removing material of base film 131 entirely from the region of opening 242. As an alternative to the embodiment presently shown, the base film can also extend only far enough, when viewed from center M of receptacle 111, that base film 131 does not rest on or in the region of extraction openings 114 or does not extend into this region, respectively.

According to the disclosure, lower tool 101 comprises a lifting element 240 which preferably does not coincide with extraction opening 114 of edge extractor 170. This means that neither the extraction opening itself nor parts of the lower tool forming or enclosing the extraction opening form lifting element 240.

As shown in FIG. 2B, lifting element 240 is spaced a distance R4 from center M of receptacle 111 and is located between sealing elements 113 and 116. The lifting element projects preferably by a height h beyond the contact surface of base film 131 on part of lower tool 101 in the direction of the upper tool and is arranged such that part of film cover 112 can rest on a contact surface of lifting element 240. In this case, the lifting element can pass through opening 242 in base film 131 in order to be made to contact film cover 112, (depending on the design of the base film).

This ensures that film cover 112 cannot rest on extraction opening 114, as shown in particular in FIG. 2A, but remains spaced at approximately height h from extraction opening 114, even if the extraction opening causes the extraction of the gas volume within the packaging unit.

In the embodiment presently shown, lifting element 240 is preferably connected firmly to lower tool 101 as a pin or peg, so it always remains in the same position. However, it can also be provided that lifting element 240 is an actuatable lifting element that can be moved along the direction of the double arrow shown (i.e., towards and away from the upper tool) for example, using a suitable drive device 241 (e.g., a motor or a control cam). If a motor 241 is provided, then it can be connected to control unit 150 already described in FIG. 1, and the control unit can actuate the motor such that the lifting element is lifted at least during the period of time during which extraction opening 114 causes the extraction of gas within the packaging unit such that film cover 112 does not rest on extraction opening 114, the lifting element in the position shown in FIG. 2B is in particular positioned at a distance h from the contact surface of base film 131 on the lower tool. It can be provided that lowering lifting element 240 is caused by way of drive element 241, in particular when the upper tool is moved in the direction of the lower tool for carrying out the sealing process. It can thus be ensured that film cover 112 comes to rest reliably on the material of base film 131 and can be connected thereto, even if the film cover material is rigid. At the same time, opening 242 can be closed in this manner.

If drive element 241 is configured, for example, as a control cam or generally a passive drive device, a motion coupling with the motion of the upper tool (or with the relative motion of the upper tool and the lower tool to one another) and presently with the sealing element 124, as is described with reference to FIG. 1B, can be provided such that a motion of the sealing element 124 or generally of upper tool 102 relative to lower tool 101 is converted to a corresponding motion of lifting element 240.

Irrespective of its configuration, lifting element 240 can be made of the most resistant material possible, in particular stainless steel, or can at least have an outer surface made of stainless steel. In particular, the contact surface of lifting element 240 can be made of stainless steel or can comprise stainless steel.

The lifting element can be detachably attached in the lower tool, for example, by way of screw or plug connections (not shown), so that the lifting element can be removed without destroying either parts of the lower tool or the lifting element itself. This provides the advantage that, for example, lifting elements that are shaped differently or have different lengths can also be used, should this be necessary. Several interchangeable lifting elements 240 can be available, where individual lifting elements differ in height h at which the bearing surface or contact surface of the lifting element is located relative to the contact surface of base film 131 on the lower tool. In this way, for example, different flexibility or rigidity of the film cover can be taken into account.

Figure 2C:
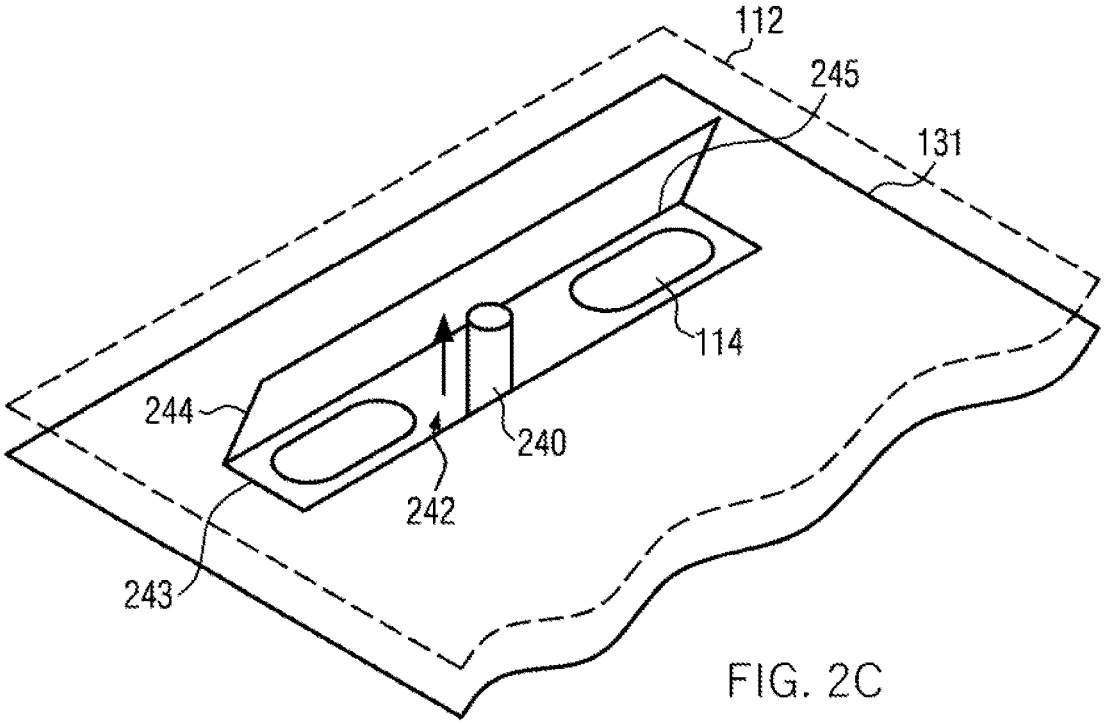

FIG. 2C shows an embodiment in a cavalier view in which the lifting element passes through an opening 242 in base film 131 in the direction of film cover 112 for lifting the latter. Opening 242 is defined by the material 243 of base film 131. It can be provided that opening 242 is formed by removing material entirely from the base film within the opening. This can be done, for example, by punching out or cutting out the material in the region of base film 131 in which opening 242 is to be formed. Alternatively (as presently shown), it can also be provided that material 242 located in the region of opening 242 is severed open on some sides of opening 242, but is not detached from the remaining material of the base film on at least one side. On that side, material 244 can then be moved away (flexed or bent over) against the remainder of the base film by a lifting element 240 passing through, so that the lifting element can pass through the opening in the direction of film cover 112. As a result, firstly, film cover 112 is reliably lifted from the extraction opening(s) 114 and cannot close them.

Secondly, it is ensured that material 244 of the base film does not come to rest on the extraction openings, so that air can be reliably extracted or evacuated from the region formed between base film 131 and film cover 112.

It can be seen in FIG. 2A in the plan view that a respective lifting element 240 is arranged between adjacent extraction openings 114. At least one lifting element is preferably provided for at least each receptacle in lower tool 101, so that at least one extraction opening associated with this receptacle can be protected by lifting element 240 associated with this receptacle from being unintentionally covered by the film cover. However, it can also be provided that at least one lifting element 240 is arranged between each two adjacent extraction openings 114, as is shown in FIG. 2A. It can there be provided in particular that lifting element 240 is arranged exactly in the middle between adjacent extraction openings 114.

FIGS. 3A to 3D show different configurations of the lifting element and in particular that part of the lifting element which projects beyond the contact surface of base film 131 on lower tool 101.

Figure 3A:
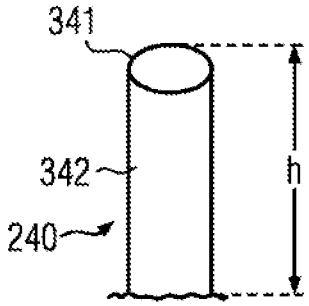
FIGS. 3A to 3D show different embodiments of a lifting element.

An embodiment is shown in FIG. 3A in which lifting element 240 has a substantially cylindrical shape, where a body 342 of the lifting element terminates in a contact surface 341 which is preferably a closed contact surface (i.e., without a hole or other openings). In the embodiment shown in FIG. 3A, this contact surface 341 is a flat surface, in particular a circle or an ellipse, depending on the shape of body 342. If the latter has an elliptical cross section, then contact surface 341 is likewise elliptical. If the body is cylindrical with a circular cross section, then contact surface 341 is likewise circular.

Figure 3B:
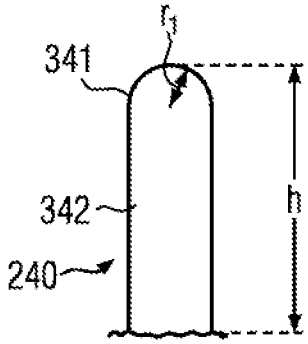

A similar embodiment is shown in FIG. 3B where body 342 of lifting element 240 is again configured to be cylindrical or elliptical in cross-section. However, contact surface 341 is there not formed as a flat surface, but as a spherical segment or ellipsoidal segment and therefore has a curved surface. In particular, the transition to body 342 can be edge-free. This configuration provides the advantage that unintentional damage to the film cover due to sharp edges of lifting element 240 can be prevented, even in the case of strong extraction power and therefore extraction effect on the film cover resting on the contact surface.

Figure 3C:
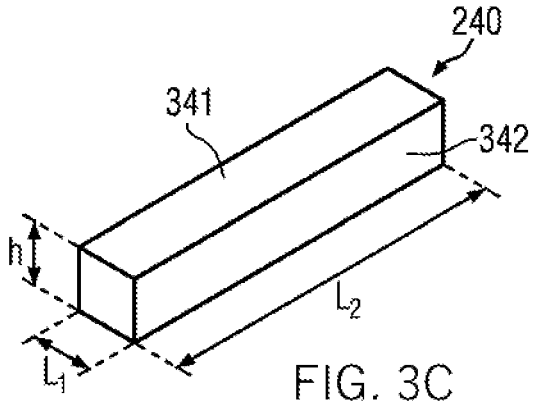

FIG. 3C shows a further embodiment in which the lifting element is substantially shaped as a cuboid which comprises a cuboid body 342 and a correspondingly rectangular-shaped bearing surface or contact surface 341. In this embodiment, the lifting element has a first dimension L1 and a second dimension L2 measured in a direction perpendicular thereto, and a height h which extends beyond the contact surface of the lower tool. In particular, the lifting element can have a greater extension in direction L2 than in direction L1. The orientation of the lifting element relative to other components of the sealing station, in particular to adjacent extraction openings, is not restricted. However, it can be provided that the lifting element is arranged such that extension L2 coincides with the connecting line between two adjacent extraction openings or runs parallel thereto, so that a larger contact surface is available in this direction for the material of the film cover.

In the embodiment shown in FIG. 3C, contact surface 341 is flat.

Figure 3D:
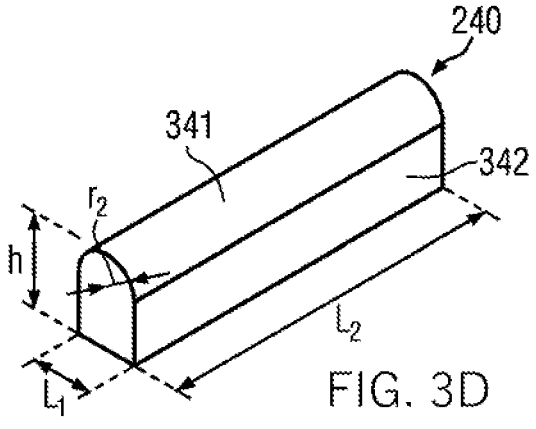

FIG. 3D shows an alternative embodiment, where contact surface 341 is shaped as a cylinder segment with a radius of curvature R2. Here as well, the lifting element and in particular the contact surface has extensions L1 and L2 in directions perpendicular to one another. In this case, the extensions L1 and L2 are measured in Euclidean coordinates and in particular not along the metrics specified by contact surface 341 itself. Dimensions L1 and L2 can therefore be identical to those of FIG. 3C, although, measured along contact surface 341 itself, the extension of contact surface 341 along direction L1 is greater when compared to FIG. 3C.

Similarly to FIG. 3B, the shape of contact surface 341 can be selected such that there are no edges at the transition to body 342 of lifting element 240 in order to avoid damage to the film material.

While the side surfaces of the lifting element according to the embodiment in FIG. 3D are shown in the plane formed by the extension of the lifting element in direction L1 and direction h presently as straight surfaces, they can also be rounded off so that sharp edges are prevented.

What has already been described with reference to FIG. 3C applies with regard to the positioning of the lifting element of FIG. 3D.

Embodiments are also conceivable in which different lifting elements according to FIGS. 3A to 3D are used together. For example, combinations of lifting elements according to FIGS. 3A and 3D or FIGS. 3B and 3D or 3A and 3C can be given. The disclosure is not restricted in this regard.

What is claimed is:

1. A sealing station for sealing packaging units, the sealing station comprising a lower tool with a receptacle for a packaging unit and an upper tool, wherein one of the lower tool and the upper tool is movable relative to the other of the lower tool and the upper tool, wherein the sealing station comprises an edge extractor with at least one extraction opening for subjecting an interior of the packaging unit to a vacuum and/or a gas and wherein the lower tool comprises a lifting element for lifting a film cover of the packaging unit, wherein the lifting element does not coincide with the at least one extraction opening.

2. The sealing station according to claim 1, wherein the lifting element is formed in a shape of a pin which comprises a closed contact surface configured to contact a film cover resting thereon.

3. The sealing station according to claim 1, wherein the lifting element has an elongate contact surface configured to contact a film cover, and the contact surface has a first extension in a first direction that is greater than a second extension of the contact surface in a second direction.

4. The sealing station according to claim 1, wherein the lifting element is firmly connected with respect to a body of the lower tool so that the lifting element does not move with respect to the body of the lower tool.

5. The sealing station according to claim 1, wherein the lifting element is movable with respect to a body of the lower tool.

6. The sealing station according to claim 1, wherein the lower tool comprises a sealing element at a distance from a center of the receptacle, the at least one extraction opening is arranged at a distance from the center of the receptacle which is shorter than the distance of the sealing element from the center of the receptacle, and wherein the lifting element is arranged at a distance from the center of the receptacle which is shorter than the distance of the sealing element from the center of the receptacle.

7. A sealing station for sealing packaging units, the sealing station comprising a lower tool with a receptacle for a packaging unit and an upper tool, wherein one of the lower tool and the upper tool is movable relative to the other of the lower tool and the upper tool, wherein the sealing station comprises an edge extractor with at least one extraction opening for subjecting an interior of the packaging unit to a vacuum and/or a gas, wherein the lower tool comprises a lifting element for lifting a film cover of the packaging unit, wherein the lower tool comprises a sealing element at a distance from a center of the receptacle and the upper tool comprises a counter-pressure element configured to contact the sealing element for sealing the interior of the packaging unit from an exterior, wherein the at least one extraction opening is arranged at a distance from the center of the receptacle which is shorter than the distance of the sealing element from the center of the receptacle, and wherein the lifting element is arranged at a distance from the center of the receptacle which is shorter than the distance of the sealing element from the center of the receptacle.

8. The sealing station according to claim 7, wherein the lifting element does not coincide with the at least one extraction opening.

9. The sealing station according to claim 7, wherein the at least one extraction opening comprises a plurality of extraction openings which are each arranged at a distance from the center of the receptacle which is shorter than the distance of the sealing element from the center of the receptacle, and wherein the lifting element is arranged between two adjacent extraction openings of the plurality of extraction openings.

10. The sealing station according to claim 9, wherein the sealing station comprises a plurality of the lifting elements, and a lifting element of the plurality of the lifting elements is arranged between each two adjacent extraction openings.

11. The sealing station according to claim 7, wherein the lower tool comprises an inner sealing element which is arranged at a distance from the center of the receptacle which is shorter than the distance of the at least one extraction opening and the distance of the lifting element from the center of the receptacle.

12. A method for sealing a packaging unit with a sealing station for sealing packaging units, wherein the sealing station comprises a lower tool with a receptacle for a packaging unit and an upper tool, one of the lower tool and the upper tool is movable relative to the other of the lower tool and the upper tool, the sealing station comprises an edge extractor with at least one extraction opening for subjecting an interior of the packaging unit to a vacuum and/or a gas, and the lower tool further comprises a lifting element for lifting a film cover of the packaging unit, wherein the method comprises lifting the film cover of the packaging unit in the receptacle by the lifting element at least in part while the interior of the packaging unit is subjected to a vacuum and/or a gas by the edge extractor;

wherein the lifting element does not coincide with the at least one extraction opening.

13. The method according to claim 12, wherein the lifting the film cover comprises lifting the film cover through an opening in a base film of the packaging unit by the lifting element.

14. The method according to claim 12, wherein after the interior of the packaging unit has been subjected to a vacuum and/or a gas, the upper tool and the lower tool are moved towards one another and the packaging unit arranged in the receptacle is sealed.

15. The method according to claim 12, wherein the lower tool comprises a sealing element at a distance from a center of the receptacle and the upper tool comprises a counter-pressure element which is contactable with the sealing element before the edge extractor is actuated for sealing the interior of the packaging unit from an exterior, wherein each of the at least one extraction opening is arranged at a distance from the center of the receptacle which is shorter than the distance of the sealing element from the center of the receptacle, and wherein the lifting element is arranged at a distance from the center of the receptacle which is shorter than the distance of the sealing element from the center of the receptacle.

16. The method according to claim 15, wherein the at least one extraction opening comprises a plurality of extraction openings which are each arranged at a distance from the center of the receptacle which is shorter than the distance of the sealing element from the center of the receptacle, and wherein the lifting element is arranged between two adjacent extraction openings.

17. The method according to claim 16, wherein the sealing station comprises a plurality of the lifting elements, and a lifting element of the plurality of the lifting elements is arranged between each two adjacent extraction openings.

18. The method according to claim 15, wherein the lower tool comprises an inner sealing element which is arranged at a distance from the center of the receptacle which is shorter than the distance of each of the at least one extraction opening from the center of the receptacle and the distance of the lifting element from the center of the receptacle.

19. The method according to claim 12, wherein the lifting element is formed in a shape of a pin which comprises a closed contact surface which contacts a film cover resting thereon.

20. The method according to claim 12, wherein the lifting element has an elongate contact surface that contacts a film cover, and the contact surface has a first extension in a first direction that is greater than a second extension of the contact surface in a second direction.

* * * * *